US007946198B2

(12) United States Patent
Gui et al.

(10) Patent No.: US 7,946,198 B2
(45) Date of Patent: May 24, 2011

(54) RATCHETING DRIVER WITH HELICAL DRIVE

(75) Inventors: Yao Kun Gui, Shanghai (CN); Hua An Xu, Shanghai (CN)

(73) Assignee: Meridian International Co., Ltd. (CN)

( * ) Notice: Subject to any disclaimer, the term of this patent is extended or adjusted under 35 U.S.C. 154(b) by 178 days.

(21) Appl. No.: 12/484,376

(22) Filed: Jun. 15, 2009

(65) Prior Publication Data

US 2010/0154600 A1 Jun. 24, 2010

(30) Foreign Application Priority Data

Dec. 22, 2008 (CN) ..... 2008 2 0157530 U

(51) Int. Cl.
*B25B 17/00* (2006.01)

(52) U.S. Cl. ..... 81/58.1; 81/57.42; 74/127

(58) Field of Classification Search ..... 81/58.1, 81/59.1, 60, 177.2, 436, 450, 57.42, 480; 74/57, 127, 89.38; 279/76
See application file for complete search history.

(56) References Cited

U.S. PATENT DOCUMENTS

| | | | | |
|---|---|---|---|---|
| 1,753,441 | A * | 4/1930 | Morehouse | 81/132 |
| 1,821,194 | A * | 9/1931 | Wilcox | 74/127 |
| 2,486,043 | A | 10/1949 | Lofgren | |
| 2,947,334 | A * | 8/1960 | Issartel | 74/127 |
| 3,511,286 | A | 5/1970 | Brauchla | |
| 3,922,935 | A * | 12/1975 | Dahlem | 81/480 |
| 4,039,013 | A | 8/1977 | Stoutenberg | |
| 4,102,375 | A * | 7/1978 | Rossini | 81/30 |
| 4,224,969 | A | 9/1980 | Plessner | |
| 4,537,100 | A | 8/1985 | Palm | |
| 5,062,749 | A | 11/1991 | Sheets | |
| 5,211,701 | A | 5/1993 | Csabafy | |
| 5,682,800 | A | 11/1997 | Jore | |
| 6,089,133 | A * | 7/2000 | Liao | 81/438 |
| 6,199,872 | B1 | 3/2001 | Hasan | |
| 7,150,212 | B2 | 12/2006 | Lee | |
| 2002/0069715 | A1 * | 6/2002 | Genco | 74/127 |
| 2002/0157506 | A1 | 10/2002 | Schade | |
| 2006/0043685 | A1 | 3/2006 | Kozak | |
| 2006/0137495 | A1 * | 6/2006 | Hwang et al. | 81/177.2 |

* cited by examiner

*Primary Examiner* — David B Thomas
(74) *Attorney, Agent, or Firm* — Timothy J. Klima; Shuttleworth & Ingersoll, PLC

(57) ABSTRACT

In accordance with one aspect of the present invention, a combination ratcheting and helical driver is disclosed. In the unlocked position the hand tool coverts downward linear force into rotary motion. In the locked position the hand tool operates as a ratcheting driver. The locking device locks the helical drive shaft of the hand tool in a retracted position such that the helical drive shaft is substantially positioned within the handle body. A locking main body is adjacent to a chuck assembly. The locking main body selectively combines with a shoulder abutment adjacent to the handle assembly to lock the helical drive shaft in the retracted position.

13 Claims, 6 Drawing Sheets

RATCHETING DRIVER WITH HELICAL DRIVE

CROSS-REFERENCE TO RELATED APPLICATIONS

The present application claims the benefit of Chinese Patent Application 200820157530.7 filed Dec. 22, 2008, which is incorporated herein by reference.

TECHNICAL FIELD

The disclosure relates to a hand tool. More specifically, the disclosure relates a locking mechanism for a ratcheting driver having a helical drive shaft that converts downward linear force into rotary motion of the drive shaft.

BACKGROUND INFORMATION

Hand tools with helical drive mechanisms are widely employed for driving tool bits such as screwdriver blades, drill bits, sockets and the like. The user is able to apply axial force on the tool handle which produces rotation of the drive shaft as it moves upwardly into a bore in the handle against the biasing action of a spring therewithin.

Hand tools with helical drive mechanisms can also be used as conventional ratcheting drivers.

However as a conventional ratcheting driver the tool's length makes it awkward and cumbersome. Accordingly, there is a need for locking mechanism for a hand tool having a helical drive to lock the helical drive in a retracted position within the handle body.

SUMMARY

In accordance with one aspect of the present invention, a combination ratcheting and helical driver is disclosed. In the unlocked position the hand tool coverts downward linear force into rotary motion. In the locked position the hand tool operates as a ratcheting driver. The locking device locks the helical drive shaft of the hand tool in a retracted position such that the helical drive shaft is substantially positioned within the handle body. A locking main body is adjacent to a chuck assembly. The locking main body selectively combines with a shoulder abutment adjacent to the handle assembly to lock the helical drive shaft in its retracted position.

BRIEF DESCRIPTION OF THE DRAWINGS

These and other features and advantages of the present invention will be better understood by reading the following detailed description, taken together with the drawings wherein.

DETAILED DESCRIPTION OF THE PREFERRED EMBODIMENTS

Figure 1:
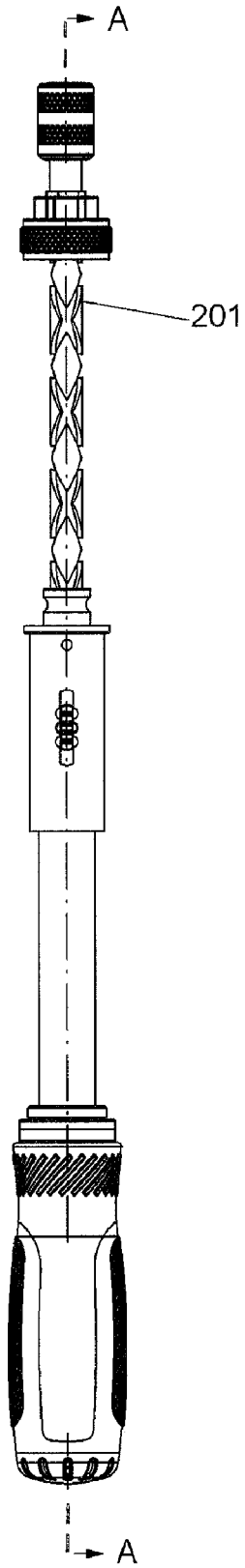
FIG. 1 is an embodiment of the hand tool described herein.
Figure 2:
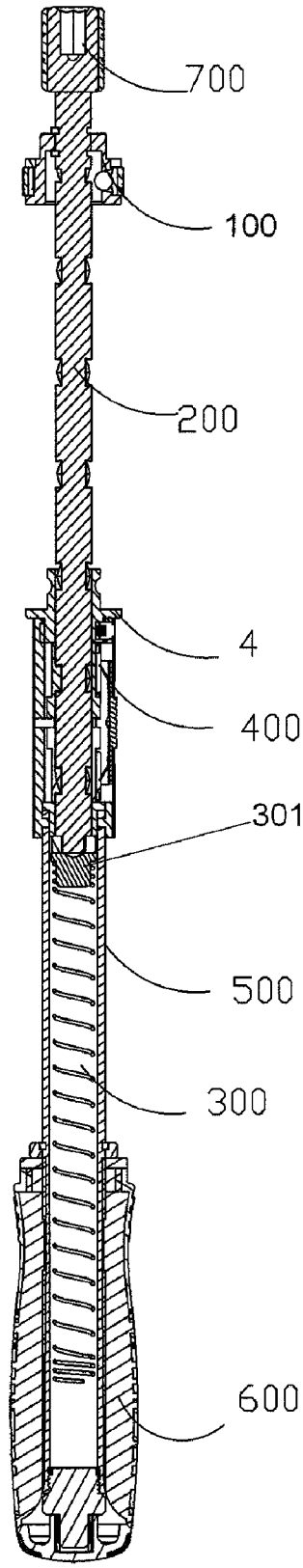
FIG. 2 is a cross-sectional view of the hand tool taken on the line A-A of FIG. 1.
Figure 3:
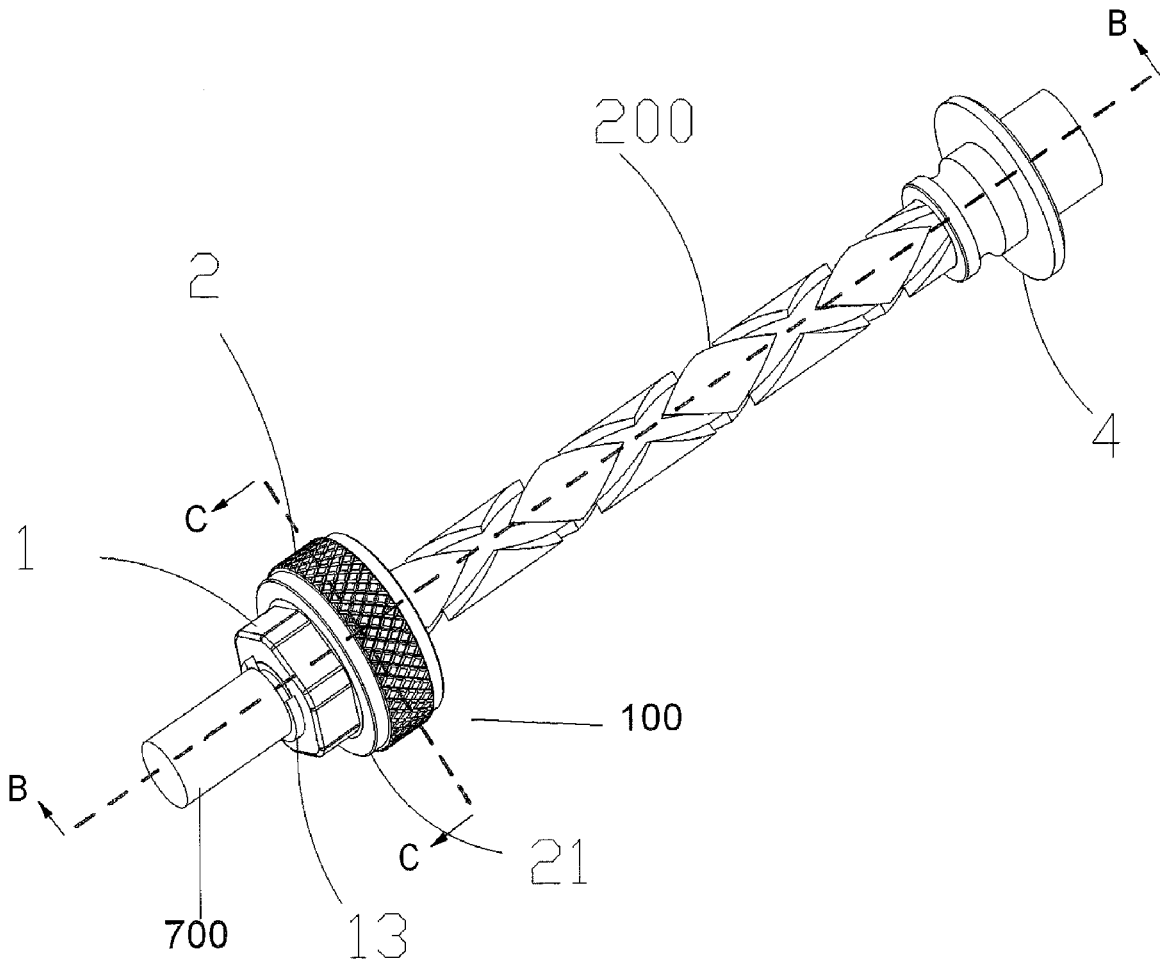
FIG. 3 is an enlarged perspective view of the locking mechanism of the hand tool.
Figure 4:
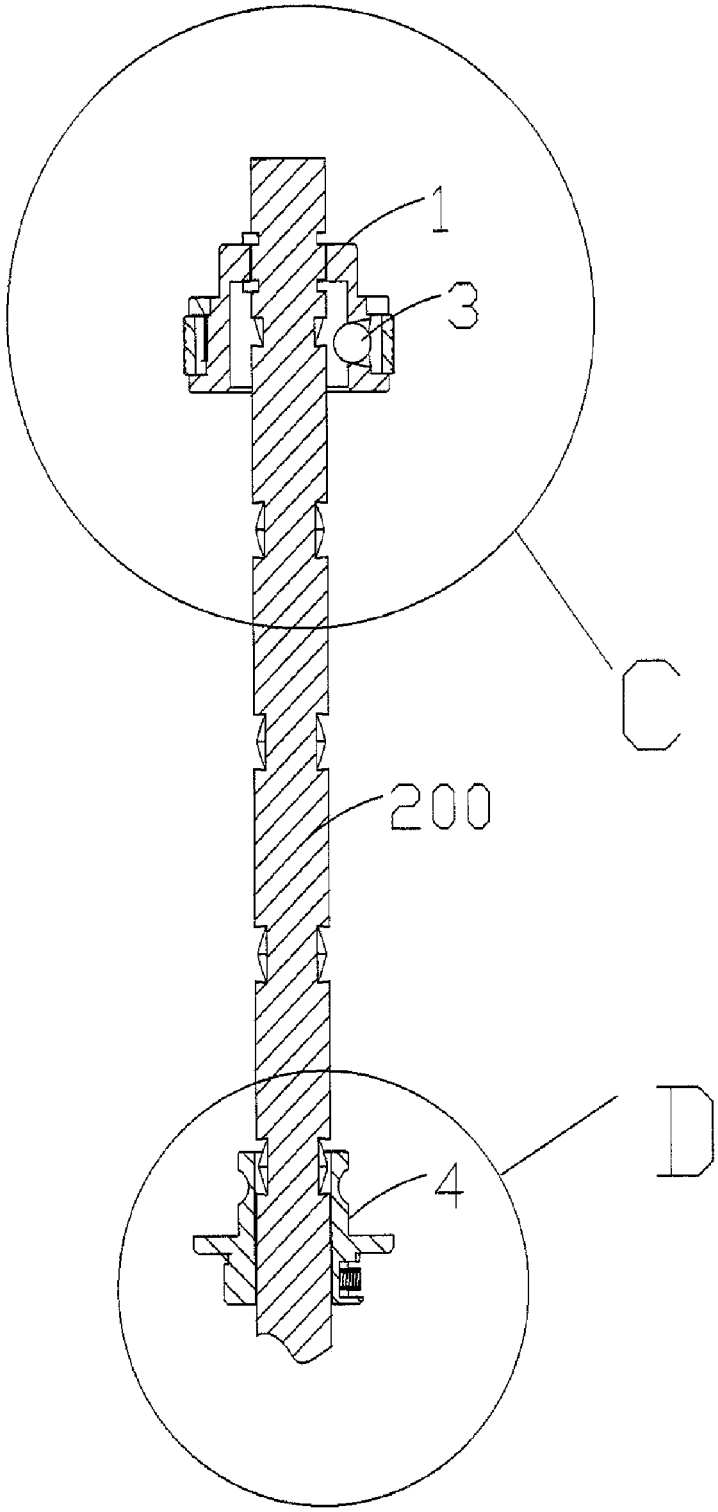
FIG. 4 is a cross-sectional view of the locking mechanism of the hand tool taken on the line B-B of FIG. 3.
Figure 5:
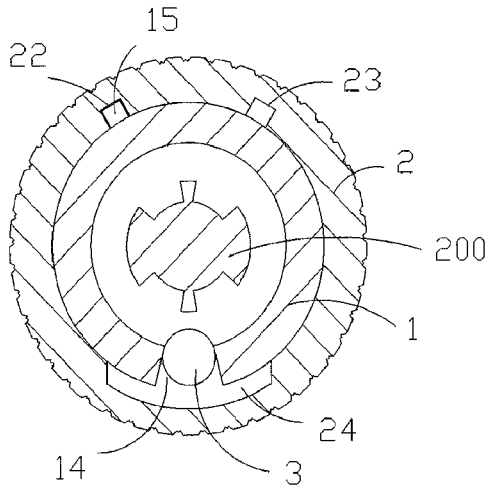
FIG. 5 is a cross-sectional view of the locking mechanism of the hand tool taken on the line C-C of FIG. 3.
Figure 6:
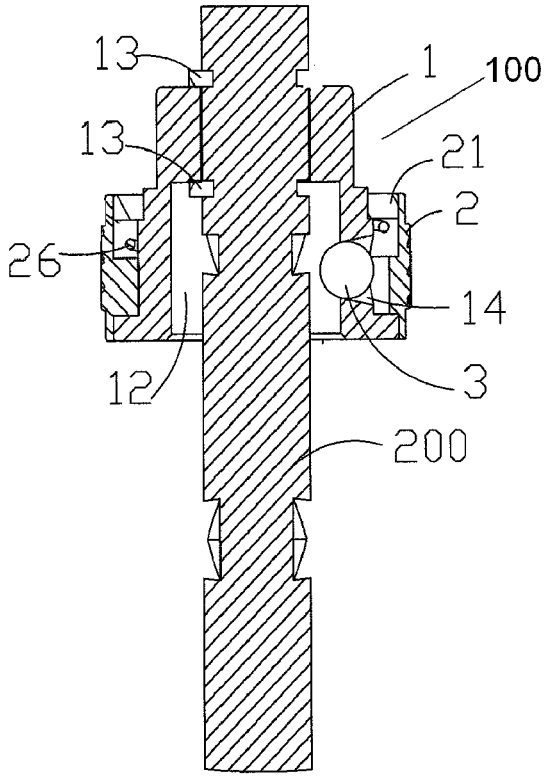
FIG. 6 is an enlarged cross-sectional view for section C of FIG. 4 of the locking mechanism of the hand tool.
Figure 7:
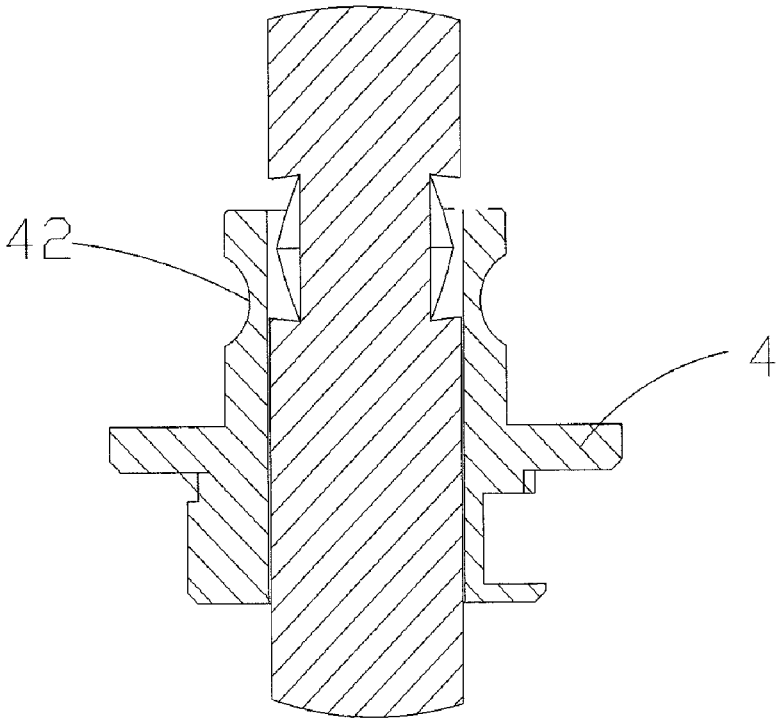
FIG. 7 is an enlarged cross-sectional view for section D of FIG. 4 of the shoulder abutment provided on the hand tool.
Figure 8:
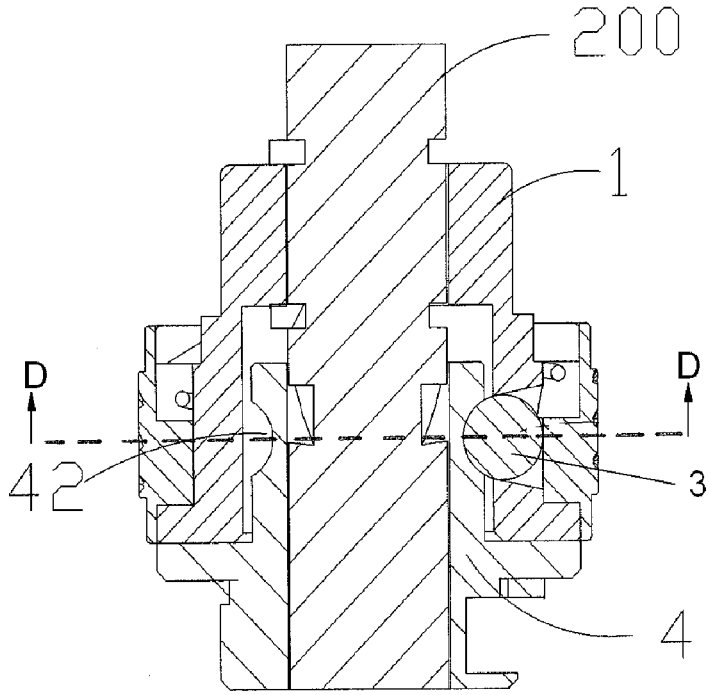
FIG. 8 is another enlarged cross-sectional view of the locking mechanism illustrated in FIG. 6 combined with the shoulder abutment of FIG. 7.
Figure 9:
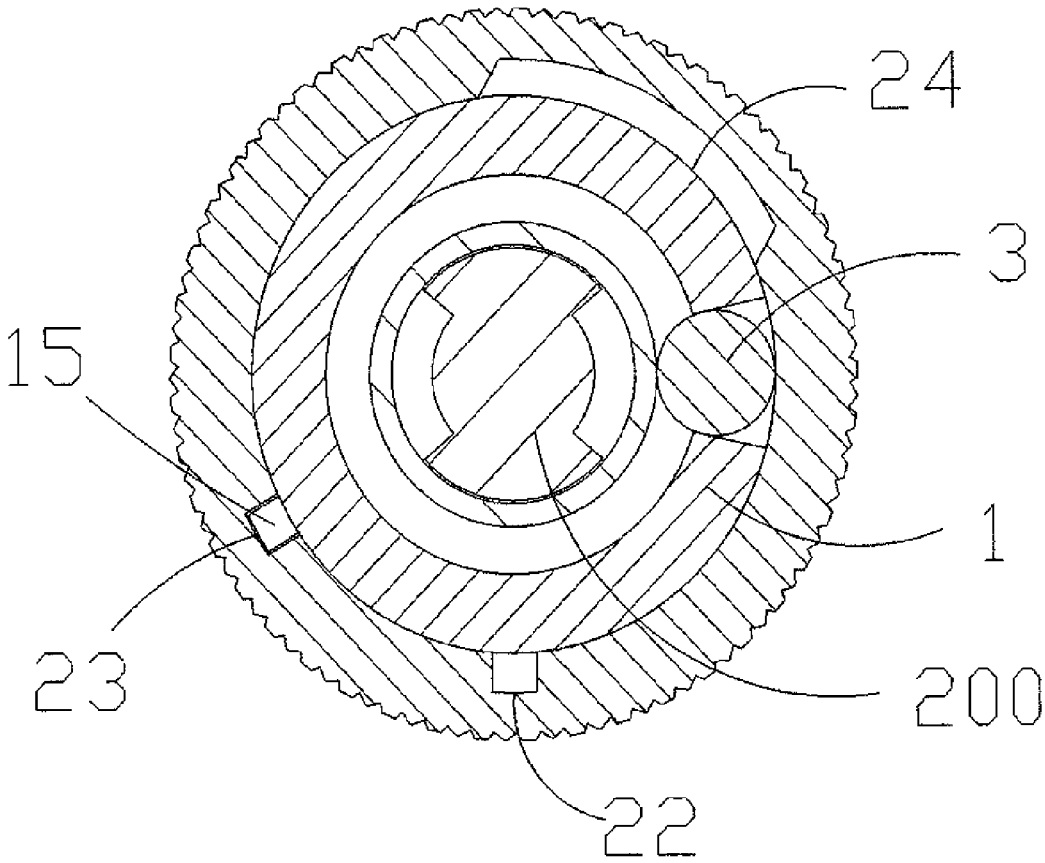
FIG. 9 is yet another cross-sectional view of the locking mechanism combined with the shoulder abutment taken on the line D-D of FIG. 8, wherein the locking mechanism is in the locked position.

Referring to FIGS. 1-2, a hand tool generally comprising, a handle grip 600 over an elongated handle body 500 having a circular cross section and a bore extending inwardly the length of the handle body for receiving a compression spring 300 which biases a helical drive shaft 200 outward. A ratcheting mechanism 400 controls the direction of rotation of a helical drive shaft 200, a locking mechanism 100 locks the helical drive shaft in a retracted position, and a quick release mechanism 700 releaseably engages tool bits of various sizes.

The helical drive shaft 200 is slidably seated for helical movement within the handle body 500. The helical drive shaft 200 generally has a circular cross section and is provided with a helical groove 201 cooperatively dimensioned and configured to slidably fit within the handle body 500. A helical shaped guide (not shown) engages the helical grooves 201 on the helical drive shaft to cause rotational motion of the drive shaft 200. Thus linear force applied at the outer end of the helical drive shaft 200 will move it rotationally through the helical shaped guide.

A compression spring 300 biases the helical drive shaft 200 outward. The spring 300 is disposed within the handle body 500 between the end of the bore and a spring guide 301. The spring guide 301 is combined with the helical drive shaft 200 and provides a surface for which the spring 300 compresses and pushes the helical drive shaft 200 outward. A stop (not shown) positioned with the handle body 500 limits the extension of the helical drive shaft 200.

Rotational direction of the helical drive shaft 200 is determined by the ratcheting mechanism 400. The ratcheting mechanism 400 is operatively combined with the helical drive 200 to selectively allow the helical drive to rotate clockwise or counter-clockwise, or remain in a locked rotation position. The operation of ratcheting mechanisms 400 is well known in the art and any ratcheting mechanism adaptable to combine with the hand tool is encompassed by the disclosed embodiment. Being well known in the art the operation of such ratcheting mechanism will not be discussed further.

At the outer end of the helical drive shaft 200 is a conventional chuck assembly 700. The chuck assembly 700 in a preferred embodiment is of the quick release variety adapted to releasably engage tool bits of various types and sizes (not shown) and which, being of the convention variety will not be discussed further.

Referring to FIGS. 3-9, adjacent to the chuck assembly 700 is the locking mechanism 100. The locking mechanism 100 selectively combines with a shoulder abutment 4 to hold the spring 300 in the compressed position. In the compressed position, the helical drive shaft 200 is disposed within the bore of the handle body 500. With the helical drive shaft 200 disposed therein, the tool operates like a standard ratcheting driver. The lock down feature of the disclosed embodiment enables the user to operate the ratcheting driver in the locked down position safely without fear that the helical drive shaft 200 will spontaneously extend from the retracted position and injure the user or the object the user is working on.

The locking mechanism 100 includes a main body 1 that is combined with the helical drive shaft 200 and held firmly in position by a pair of snap rings 13 that combine with the helical drive shaft 200. A rotary switch 2 rotatably combined with the outside of the main body 1 is held in place by a retaining ring 21. The rotary switch 2 has a cylindrical cross section and is formed with first and second square grooves 22 & 23 in the inner circumference of the rotary switch and offset at an angle from center from each other. The rotary switch 2 is also formed with an arc shaped groove 24 opposite the square grooves 22 & 23 (FIG. 5) along the inner circumference of the rotary switch.

The square grooves 22 & 23 are adapted to selectively align with a protrusion 15 formed in the main body 1. When the first square groove 22 is engaged with the protrusion 15, the arc-shaped groove 24 is opposite the opening 14 and the combination of the groove 24 and opening 14 form an enlarged chamber. Alternatively, when the second square groove 23 is engaged with the protrusion 15, the arc-shaped groove 24 is offset from the opening 14.

A steel ball 3 is positioned in the opening 14 of the main body 1. When the arc shaped groove 24 is opposite the opening 14 the steel ball 3 is loosely positioned in the chamber. Alternatively, when the arc shaped groove 24 is offset from the opening 14, the steel ball 3 is held firmly in the opening 14 by the inner sidewall of the rotary switch 2.

The opening 14 has a tapered cross-section which allows the steel ball 3 to partially extend into a cavity 12. When the helical drive shaft 200 is retracted with the spring 300 compressed, the shoulder abutment 4 is positioned in the cavity 12 and a groove 42 formed in the shoulder abutment 4 receives the portion of the steel ball 3 that extends into the cavity. When the arc shaped groove 24 is offset from the opening, the steel ball is held in the groove 42 by the inner sidewall of the rotary switch 2 to prevent the helical drive shaft 200 from extending.

In operation beginning from the unlocked position, the protrusion 15 is engaged in the first square groove 22, the arc shaped groove 24 is aligned with the opening 14, and the steel ball 3 is loosely arranged therein. To move the locking mechanism to the locked position the rotary switch 2 is pushed up along the axial direction of the helical drive shaft 200 at which time the first square groove 22 is separated from the protrusion 15. The rotary switch 2 is then rotated and the second square groove 23 is aligned with the protrusion. A spring 26 urges the rotary switch 2 to the seated position. In the locked position the arc shaped groove 24 is rotated such that the steel ball 3 is no longer loosely arranged and the steel ball 3 is held in position by the inner circumference of the rotary switch 2.

To unlock the locking mechanism 100, the arc shaped groove 24 must be rotated into alignment with the steel ball 3. In an embodiment this operation may be carried out by two-hands. The necessity of two-hands for unlocking the tool is a safety feature that prevents the operator from being injured when the helical drive shaft 200 rapidly extends out of the handle body 500. The main body 1 is held while the rotary switch 2 is moved upward and then rotated to align the protrusion 15 with the first square groove 22. The steel ball is then released from its fixed position engaged in the groove 42 of the shoulder abutment 4.

While the principles of the invention have been described herein, it is to be understood by those skilled in the art that this description is made only by way of example and not as a limitation as to the scope of the invention. Other embodiments are contemplated within the scope of the present invention in addition to the exemplary embodiments shown and described herein. Modifications and substitutions by one of ordinary skill in the art are considered to be within the scope of the present invention, which is not to be limited except by the following claims.

What is claimed is:

1. A locking device for locking a helical drive shaft of a ratcheting hand tool in a retracted position with the helical drive shaft substantially positioned within a handle body, the hand tool further having a chuck assembly at the outer end of the helical drive shaft for releaseably engaging tool bits, the locking device comprising:

a shoulder abutment adjacent to the handle body, said shoulder abutment having a protrusion with a groove around its circumference and a bore extending therethrough being coaxially aligned with the handle body for receiving the helical drive shaft; and a locking main body combined with the chuck assembly, wherein said locking main body is adapted to releasably combine with said shoulder abutment to lock the helical drive shaft in the retracted position.

2. The locking device of claim 1, wherein the locking main body further comprises a rotary switch operatively positioned around the outside of the locking main body to lock selectively lock the helical drive shaft in the retracted position.

3. The locking device of claim 1 further comprises a steel ball combined with the locking main body and extending into an opening formed therein, wherein said steel ball selectively engages said groove on the said shoulder abutment to prevent the helical drive shaft from retracting.

4. A hand tool adapted to receive bits, the hand tool comprising:

a handle body having a circular cross section and a bore extending therein;

a spring positioned in said bore;

a helical drive shaft outwardly biased by said spring and traversable with said handle body a ratcheting mechanism operatively combined with said helical drive shaft;

a coupling assembly positioned at the end of said helical drive shaft for receiving bits of various sizes;

a locking mechanism adjacent to the coupling assembly for selectively locking said helical drive shaft in the retracted position; and a shoulder abutment having an annular groove around its circumference and positioned at the end of said handle body for selectively engaging said locking mechanism to hold said helical drive shaft in the retracted position.

5. The hand tool of claim 4, wherein said locking mechanism further comprises a ball to engage said annular groove on said shoulder abutment to selectively hold the helical drive shaft in the retracted position.

6. The hand tool of claim 4, wherein the locking mechanism further comprises a rotary switch operatively combined around said locking mechanism, where in said rotary switch is moveable between a locked and unlocked position.

7. The hand tool of claim 6 wherein the locking mechanism is adapted to rotate to the unlocked position only by the operator using both hands.

8. The hand tool of claim 4 adapted to translate downward linear force to rotational motion.

9. The hand tool of claim 8 adapted to lock said helical drive shaft in a retracted position, wherein in the retracted position the hand tool operates substantially similar to a ratcheting driver.

10. A hand tool adapted to receive bits, the hand tool comprising:

a handle body having a circular cross section and a bore extending therein;

a spring positioned in said bore;

a helical drive shaft outwardly biased by said spring and traversable with said handle body;

a ratcheting mechanism operatively combined with said helical drive shaft;

a coupling assembly positioned at the end of said helical drive shaft for receiving bits of various sizes;

a locking mechanism adjacent to the coupling assembly for selectively locking said helical drive shaft in the retracted position; and a shoulder abutment adjacent to the handle body, said shoulder abutment having a protrusion with a groove around its circumference and a bore extending therethrough and coaxially aligned with the handle body for receiving the helical drive shaft.

11. The hand tool of claim 10, wherein said locking mechanism further comprises a locking main body adjacent with a chuck assembly, wherein said locking main body is adapted to releasably combine with said shoulder abutment to lock the helical drive shaft in the retracted position.

12. The hand tool of claim 11, wherein the locking main body further comprises a rotary switch operatively positioned around the outside of the locking main body to selectively lock the helical drive shaft in the retracted position.

13. The hand tool of claim 12, wherein the locking mechanism further comprises a steel ball combined with the locking main body and extending into an opening formed therein, wherein said steel ball selectively engages said groove on the said shoulder abutment to prevent the helical drive shaft from retracting.

* * * * *